United States Patent [19]

Collier

[11] Patent Number: 5,041,010

[45] Date of Patent: Aug. 20, 1991

[54] ELECTRICAL CONNECTOR

[75] Inventor: John C. Collier, Southport, United Kingdom

[73] Assignee: ITT Industries Limited, Hampshire, United Kingdom

[21] Appl. No.: 538,955

[22] Filed: Jun. 15, 1990

[30] Foreign Application Priority Data

Dec. 15, 1987 [GB] United Kingdom ..... 8729224

[51] Int. Cl.[5] ..... H01R 4/24

[52] U.S. Cl. ..... 439/418; 439/346

[58] Field of Search ..... 439/389, 391, 417, 418, 439/425, 426, 401, 676, 660, 346

[56] References Cited

U.S. PATENT DOCUMENTS

| | | | |
|---|---|---|---|
| 4,002,392 | 1/1977 | Hardesty | 439/418 |
| 4,428,636 | 1/1984 | Kam et al. | 339/97 |
| 4,566,749 | 1/1986 | Johnston | 439/660 |
| 4,577,921 | 3/1986 | Bogese, II | 439/426 |

FOREIGN PATENT DOCUMENTS

| | | |
|---|---|---|
| 0104013 | 8/1983 | European Pat. Off. . |
| 2180703 | 4/1987 | United Kingdom . |

*Primary Examiner*—Larry I. Schwartz
*Assistant Examiner*—Hien D. Vu
*Attorney, Agent, or Firm*—Thomas L. Peterson

[57] ABSTRACT

A connector of the plug and socket type comprises a housing (3) having a chamber (4) into which extend, one or more conductive pins (5). A second housing (8) is adapted to be received in the chamber (4). When the housing (8) is fully inserted in the chamber (4) the pins (5) pass through a first aperture (24) and a second aperture (25). Between these apertures, the pins are deformed by a projection (18) and retained thereby. The projection (18) forms part of a contact element (15) which is provided with tines (17) engaging the conductors of an inserted cable (12).

19 Claims, 3 Drawing Sheets

FIG. 4
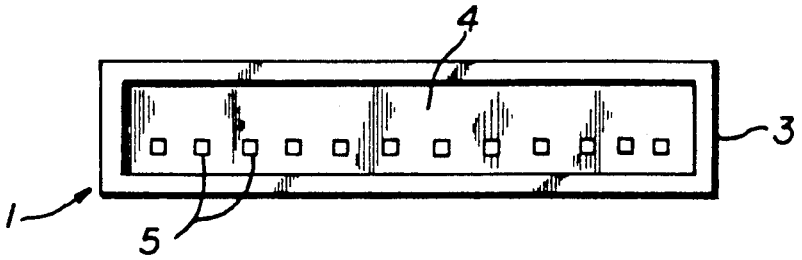
FIG. 5
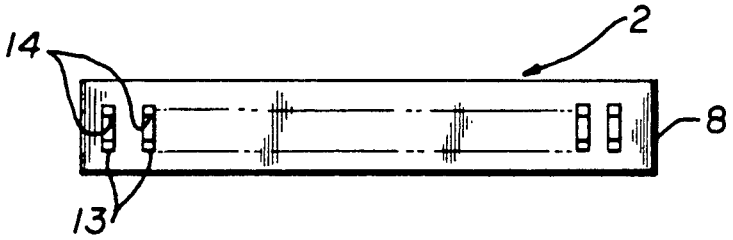
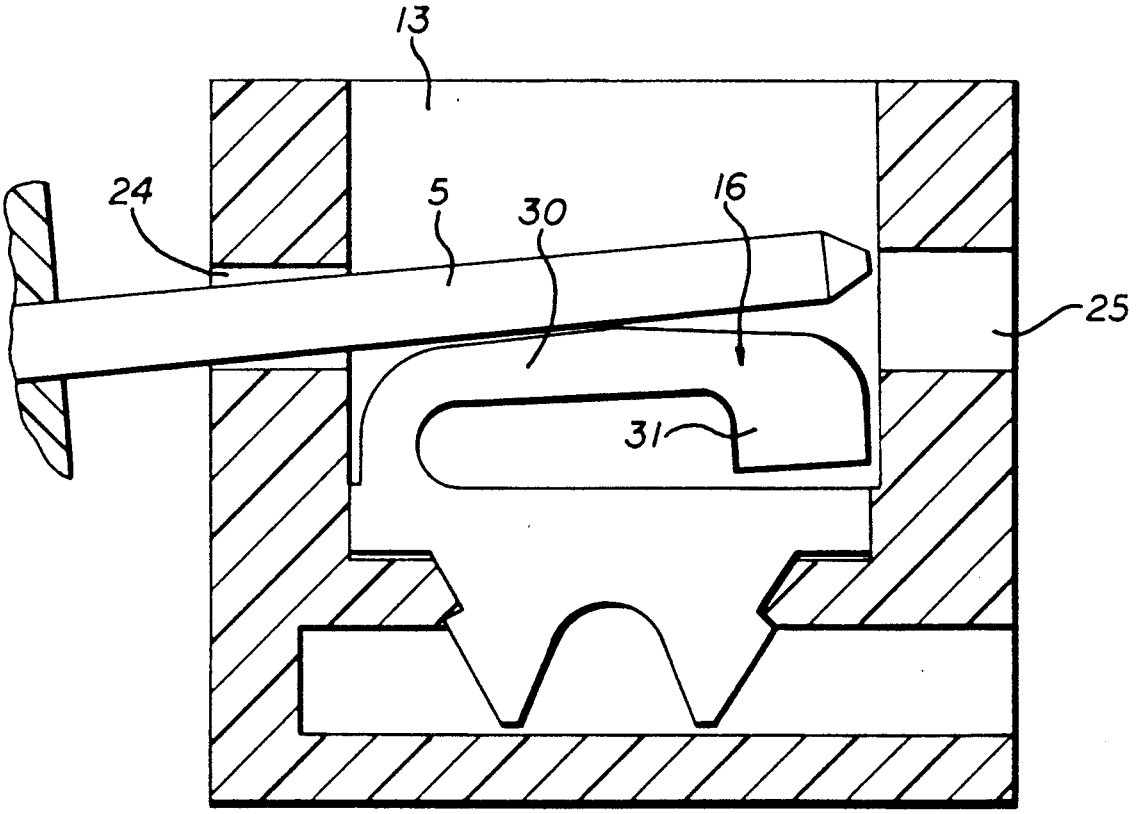
FIG. 3

ELECTRICAL CONNECTOR

BACKGROUND

This invention relates to electrical connectors and in particular to electrical connectors for making an electrical connection between one or more insulated conductors and one or more header pins. By the term insulated conductor there is herein meant to include solid conductors and stranded conductors together with other types of conductors such as tinsel conductors, whenever insulated by a covering of insulating material. Header pins are elongate conductive posts which may be inserted into the plated through holes of a printed circuit board and soldered in position. The header pins are conventionally either directly secured to the printed circuit board, or alternatively mounted in an insulating moulding which maintains them in a predetermined spacing one with respect to another.

It is an object of the present invention to provide an improved electrical connector for connecting one or more insulated conductors and one or more header pins.

BRIEF DESCRIPTION OF THE INVENTION

The present invention provides an electrical connector for making an electrical connection between one or more insulated conductors and one or more header pins, the connector comprising an insulating housing, the housing having one or more conductor receiving cavities and at least one aperture through which one or more insulated conductors may be introduced into the one or more conductor receiving cavities, one or more header receiving cavities, at least one entrance through which one or more header pins may be introduced into the one or more header receiving cavities, one or more orifices communicating with the one or more header receiving cavities, and one or more contact receiving openings communicating between the one or more conductor receiving cavities and the one or more header receiving cavities; the connector further including one or more electrical contacts each associated with a respective one of the one or more contact receiving openings and each comprising a terminating portion adapted to make an electrical connection with an electrical conductor of one of the one or more insulated conductors, and a contact area adapted to engage and make an electrical connection with an associated header pin, the arrangement being such that when the one or more electrical contacts are in a terminated position each contact area protrudes into one of the one or more header receiving cavities such that a respective header pin introduced through the at least one entrance is engaged by the contact area such that at least one of either the header pin or the contact area is caused to flex, further insertion of the header pin causing it to be received in one of the one or more orifices, the header pin being urged against the contact area to provide an electrical connection therewith.

Preferably the terminating portion of each of the one or more electrical contacts comprises one or more tines adapted to pierce the insulating covering of one of the one or more insulated conductors. Each of the one or more orifices is preferably adapted to form an interference fit with the one or more header pins. In this way a degree of mechanical locking may be provided for the header pins when they are fully inserted. This will help to prevent inadvertent withdrawal of the one or more header pins from the electrical connector.

Conveniently the at least one entrance through which the one or more header pins may be introduced comprises a plurality of entrances provided in the insulating housing adjacent the one or more header receiving cavities. Thus header pins may be introduced through the plurality of entrances into the header receiving cavities in order either to flex or to be flexed by the contact area of the electrical contacts and received in the one or more orifices. There is preferably provided both a plurality of orifices and a plurality of entrances in the insulating housing, one plurality adjacent each end of the one or more header receiving cavities. The insulated housing is conveniently in the form of a one piece integral moulding.

Preferably each contact area is such that an associated header pin is engaged thereby and caused to flex. Conveniently the contact area of at least one of the one or more electrical contacts includes an angled face adapted to assist in the flexing of an associated header pin. Preferably the angled face is a part of a projection extending from at least one of the one or more electrical contacts. In a preferred arrangement each of the one or more electrical contacts is of one piece integral construction.

The invention further resides in an electrical connector for making an electrical connection between a plurality of insulated conductors and a plurality of header pins, the connector comprising an insulating housing, the housing having a conductor receiving cavity and an aperture through which the plurality of insulated conductors may be introduced into the conductor receiving cavity, a plurality of header receiving cavities, a plurality of entrances through which the header pins may be introduced into the header receiving cavities, a plurality of orifices, each orifice being in communication with one of the header receiving cavities, and a plurality of contact receiving openings communicating between the conductor receiving cavity and the plurality of header receiving cavities; the connector further including a plurality of electrical contacts each associated with a respective one of the contact receiving openings and each comprising an insulation piercing portion including one or more tines adapted to pierce the insulating covering of one of the insulated conductors and make an electrical connection with an electrical conductor therein, and a contact area adapted to engage and make an electrical connection with an associated header pin, the housing and the electrical contacts being movable one with respect to the other between a partly inserted position in which the electrical contacts are partly inserted in the contact receiving openings with the one or more tines being clear of the conductor receiving cavity, and a terminated position in which the one or more tines protrude into the conductor receiving cavity to pierce the insulating covering of an insulated conductor received therein, the arrangement being such that when the electrical contacts are in the terminated position each contact area protrudes into one of the header receiving cavities such that a respective header pin introduced through one of the entrances is engaged by the contact area such that at least one of either the contact area or the header pin is caused to flex, further insertion of the header pin causing it to be received in one of the orifices, the header pin being urged against the contact area to provide an electrical connection therewith.

The invention further resides in a two-part electrical connector including a first part comprising a first insulating housing having a chamber therein and a plurality of header pins mounted in the housing and extending into the chamber; and a second part comprising a second insulating housing, the housing having a conductor receiving cavity and an aperture through which a plurality of insulated conductors may be introduced into the conductor receiving cavity, a plurality of header receiving cavities, a plurality of entrances through which the header pins may be introduced into the header receiving cavities, a plurality of orifices, each orifice being in communication with one of the header receiving cavities, and a plurality of contact receiving openings communicating between the conductor receiving cavity and the header receiving cavities, the second housing further including a plurality of electrical contacts each associated with a respective one of the contact receiving openings and each comprising an insulation piercing portion including one or more tines adapted to pierce the insulating covering of one of the insulated conductors and make an electrical connection with an electrical conductor therein, and a contact area adapted to engage and make an electrical connection with an associated header pin, the housing and the electrical contact being movable one with respect to the other between a partly inserted position in which the electrical contacts are partly inserted in the contact receiving openings with the one or more tines being clear of the conductor receiving cavity, and a terminated position in which the one or more tines protrude into the conductor receiving cavity to pierce the insulating covering of an insulated conductor received therein, the second insulating housing being receivable within the chamber of the first insulating housing with the header pins being introduced through the entrances and into the header receiving cavities, the arrangement being such that when the electrical contacts are in the terminated position each contact area protrudes into one of the header receiving cavities such that a respective header pin introduced through one of the entrances is engaged by the contact area such that at least one of either the header pin or the contact area is caused to flex, further insertion of the header pin causing it to be received in one of the orifices, the header pin being urged against the contact area to provide an electrical connection therewith.

THE DRAWINGS

The invention will now be further described, by way of example only, with reference to the accompanying drawings, in which:

FIG. 3 is a cross-sectional view of another alternative embodiment of connector according to the invention;

FIG. 4 is an end view of the first part of the connector showing a plurality of header pins; and FIG. 5 is a top view of the second part of the connector.

DETAILED DESCRIPTION

Figure 1:
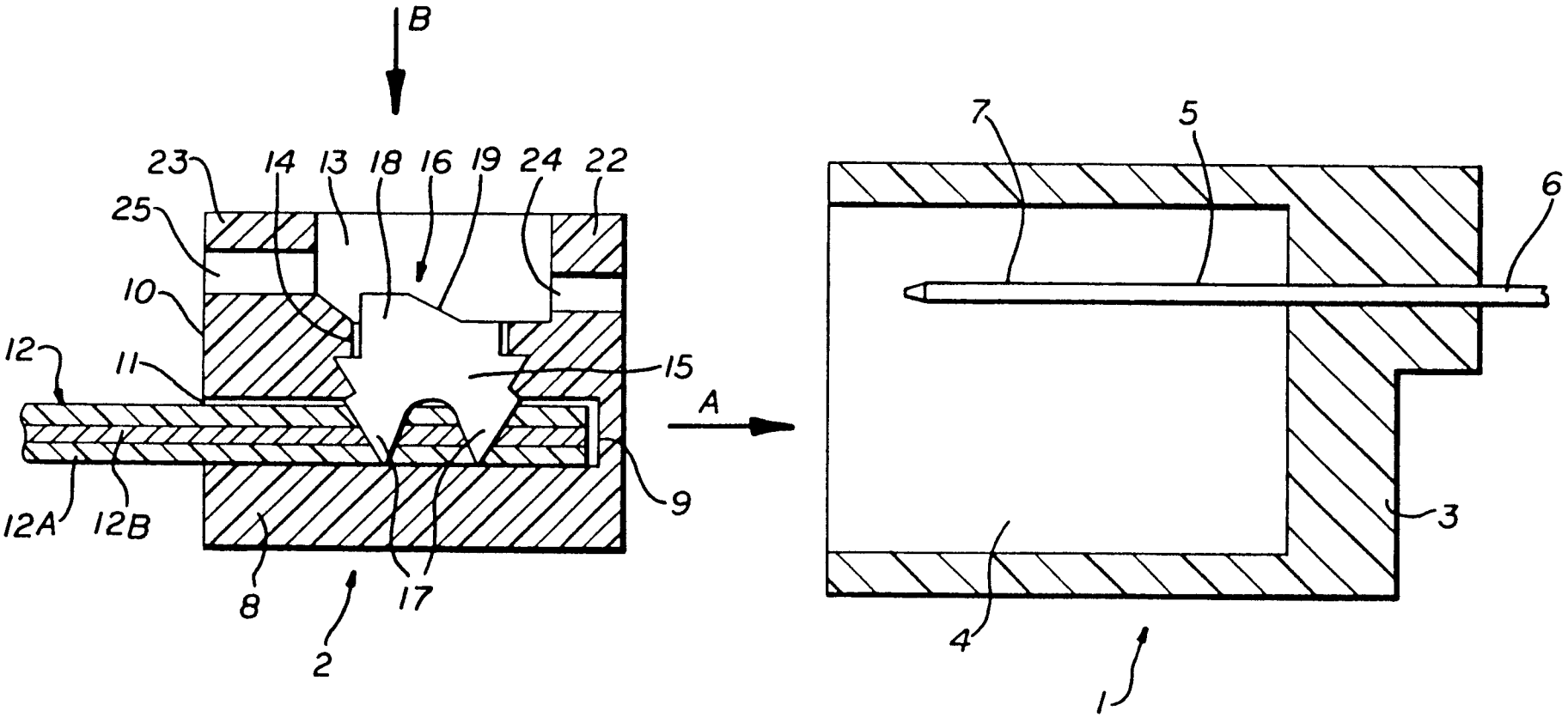
FIG. 1 is an exploded sectional diagram of a two-part connector according to the invention.

Referring to FIGS. 1, 4 and 5, the connector comprises a first part shown generally at 1 and a second part shown generally at 2. The first part 1 comprises a moulded insulating housing 3 having a chamber 4 therein. Mounted in the housing 3 are a plurality of header pins 5 each comprising a tail portion 6 for securing in a printed circuit board (not shown), and a nose portion 7 extending into the chamber 4.

The second part 2 of the connector comprises a further moulded insulating housing 8 which is dimensioned so as to be snugly receivable within the chamber 4. The housing 8 defines an elongate cavity 9, one end face 10 of the housing 8 being provided with an aperture 11 through which the cavity 9 opens to the exterior of the connector. The cavity 9 is such that a plurality of insulated conductors, shown at 12 in FIG. 1, may be received therein through the aperture 11.

The housing 8 also includes a plurality of recesses 13 each dimensioned such that the nose portion 7 of one of the header pins 5 can be accommodated therein. The recesses 13 are in communication with the cavity 9 by means of channels 14, each channel containing a contact element 15. Each contact element is of a one piece integral construction and includes a contact area shown generally at 16 and an insulation piercing portion comprising two sharp-edged tines 17. The contact element 15 is shown in FIG. 1 in its terminated position, in which it has been inserted into the cavity 9 to pierce the insulating covering of one of the insulated conductors 12, in known fashion. The contact area includes a projection 18 extending into the recesses 13, so as to provide an angled face 19.

The housing 8 further includes first and second bridge mouldings 22, 23 either side of the recesses 13. A first set of boreholes 24 is provided in the first bridge moulding 22, and a second set of boreholes 25 is provided in the second bridge moulding 23.

In use the contact elements 15 are inserted into the channels 14 to pierce the insulating covering of the insulated conductors 12 to make an electrical connection with the electrical conductors therein. The second part 2 of the connector is then mated with the first part 1, with the housing 8 being received within the chamber 4. Each header pin 5 is introduced through one of the boreholes 24 and received in one of the recesses 13, the nose portion being deflected by the angled face 19 of the projection 18 such that the header pin becomes flexed. Further insertion of the flexed header pins causes them to be received in the second set of boreholes 25. The boreholes 25 serve to restrict further deflection of the header pins 5 and generate a contact pressure between the header pins and the contact elements 15. In this way an effective electrical connection is formed between the header pins and the electrical contact elements 15 and hence the conductors 12. The second boreholes 25 also serve to lock the flexed header pins in the housing 8, thereby preventing inadvertent separation of the header pins and the contact elements 15.

Figure 2:
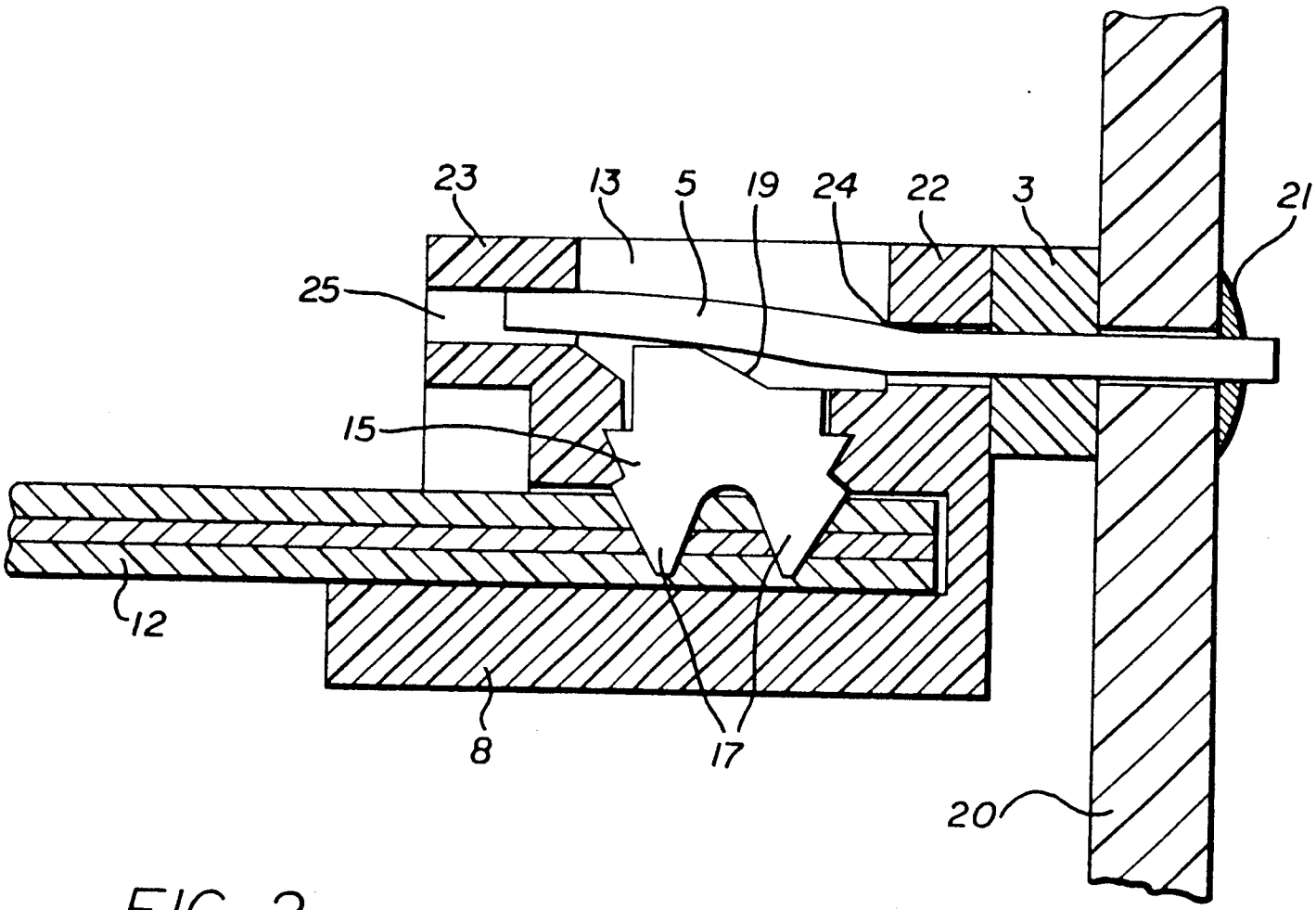
FIG. 2 is a cross-sectional view of an alternative embodiment of connector according to the invention.

FIG. 2 shows an alternative embodiment of electrical connector in which like features are designated with like reference numerals. The pins 5, as opposed to being shown received in chamber 4 as in FIG. 1, are shown inserted directly in a circuit board 20 and secured with solder as shown at 21. The moulded housing 3 is still present in order to regulate the spacing of the header pins 5.

It will be appreciated that various alternative embodiments may be envisaged without departing from the scope of the present invention. For example, although the second boreholes 25 are shown in FIGS. 1 and 2 at a different height from the first boreholes 24 in order to receive the flexed header pins, the boreholes may equally be located at a common height and with a cam surface being provided to guide the header pins into position. These and other alternative arrangements will all be appreciated by the skilled man as being within the scope of the present invention.

FIG. 3 shows an alternative embodiment of connector in which the contact area 16 is in the form of a resilient cantilever arm 30. In FIG. 3 like features are again designated with like reference numerals, each header pin 5 being introduced into one of the recesses 13 through the first boreholes 24. The header pin engages the cantilever arm 30 deflecting it downwardly towards the body of the contact element 15, an enlarged portion 31 limiting the movement of the cantilever arm to prevent overstressing thereof. The fully inserted header pins are received in the second set of boreholes 25 as before.

The header pins may flex the cantilever arms 30 in one of two ways. Firstly they may engage the arms as they are introduced into the recesses 13, causing progressive deflection as they are further inserted. Alternatively, the pins 5 may be introduced at an angle as shown in FIG. 3, and then pivoted downwardly to engage and deflect the cantilever arms before being received in the boreholes 25. Either method may be conveniently employed depending on the rigidity of the header pins 5 and their width with respect to that of the first boreholes 24.

Having described the invention in connection with certain embodiments thereof, modification may now suggest itself to those skilled in the art. Accordingly, the invention itself is not to be limited to the disclosed embodiments, except as required by the appended claims.

I claim:

1. An electrical connector for making an electrical connection between one or more insulated conductors and one or more header pins, the connector comprising an insulating housing, the housing having one or more conductor receiving cavities and at least one aperture through which one or more insulated conductors may be introduced into the one or more conductor receiving cavities, one or more header receiving cavities, at least one entrance through which one or more header pins may be introduced into the one or more header receiving cavities, one or more orifices communicating with the one or more header receiving cavities, and one or more contact receiving openings communicating between the one or more conductor receiving cavities and the one or more header receiving cavities; the connector further including one or more electrical contacts each associated with a respective one of the one or more contact receiving openings and each comprising a terminating portion adapted to make an electrical connection with the electrical conductor of one of the one or more insulated conductors, and a contact area adapted to engage and make an electrical connection with an associated header pin, characterized in that when the one or more electrical contacts are in a terminated position each contact area protrudes into one of the one or more header receiving cavities such that a respective header pin introduced through the at least one entrance is engaged by the contact area such that the header pin is caused to flex, further insertion of the header pin causing it to be received in one of the one or more orifices, the header pin being urged against the contact area to provide an electrical connection therewith.

2. An electrical connector according to claim 1, characterized in that the terminating portion of each of the one or more electrical contacts comprises one or more tines adapted to pierce the insulating covering of one of the one or more insulated conductors.

3. An electrical connector according to claim 1 or claim 2 characterized in that each of the one or more orifices is adapted to form an interference fit with the one or more header pins.

4. An electrical connector according to claim 1 characterized in that the at least one entrance through which the one or more header pins may be introduced comprises a plurality of entrances provided in the insulating housing adjacent the one or more header receiving cavities.

5. An electrical connector according to claim 4, characterized in that there is provided both a plurality of orifices and a plurality of entrances in the insulating housing, one plurality adjacent each end of the one or more header receiving cavities.

6. An electrical connector according to claim 1 characterized in that the insulating housing is in the form of a one piece integral moulding.

7. An electrical connector according to claim 1 characterized in that each contact area is such that an associated header pin is engaged thereby and caused to flex.

8. An electrical connector according to claim 1 characterized in that each of the one or more electrical contacts is of one-piece integral construction.

9. An electrical connector according to claim 7 characterized in that the contact area of at least one of the one or more electrical contacts includes an angled face adapted to assist in the flexing of an associated header pin.

10. An electrical connector according to claim 9, characterized in that the angled face is a part of a projection extending from at least one of the one or more electrical contacts.

11. An electrical connector for making an electrical connection between a plurality of insulated conductors and a plurality of header pins, the connector comprising an insulating housing, the housing having a conductor receiving cavity and an aperture through which the plurality of insulated conductors may be introduced into the conductor receiving cavity, a plurality of header receiving cavities, a plurality of entrances through which the header pins may be introduced into the header receiving cavities, a plurality of orifices, each orifice being in communication with one of the header receiving cavities, and a plurality of contact receiving openings communicating between the conductor receiving cavity and the plurality of header receiving cavities; the connector further including a plurality of electrical contacts each associated with a respective one of the contact receiving openings and each comprising an insulation piercing portion adapted to pierce the insulating covering of one of the insulated conductors and make an electrical connection with an electrical conductor therein, and a contact area adapted to engage and make an electrical connection with an associated header pin, characterized in that the housing and the electrical contacts are movable one with respect to the other between a partly inserted position in which the electrical contacts are partly inserted in the contact receiving openings with the one or more tines being clear of the conductor receiving cavity, and a terminated position in which the one or more tines protrude into the conductor receiving cavity to pierce the insulating covering of an insulated conductor received therein, and characterized in that when the electrical contacts are in the terminated position each contact area protrudes into one of the header receiving cavities such that a respective header pin introduced through one of the entrances is engaged by the contact area such that the header pin is caused to flex, further insertion of the header pin causing it to be received in one of the orifices, the header pin being urged against the contact area to provide an electrical connection therewith.

12. A two-part electrical connector including a first part comprising a first insulating housing having a chamber therein and a plurality of header pins mounted in the housing and extending into the chamber; and a second part comprising a second insulating housing, the housing having a conductor receiving cavity and an aperture through which a plurality of insulated conductors may be introduced into the conductor receiving cavity, a plurality of header receiving cavities, a plurality of entrances through which the header pins may be introduced into the header receiving cavities, a plurality of orifices, each orifice being in communication with one of the header receiving cavities, and a plurality of contact receiving openings communicating between the conductor receiving cavity and the header receiving cavities, the second housing further including a plurality of electrical contacts each associated with a respective one of the contact receiving openings characterized in that each electrical contact comprises an insulation piercing portion including one or more tines adapted to pierce the insulating covering of one of the insulated conductors and make an electrical connection with an electrical conductor therein, in that a contact area is adapted to engage and make an electrical connection with an associated header pin, in that the housing and the electrical contact being movable one with respect to the other between a partly inserted position in which the electrical contacts are partly inserted in the contact receiving openings with the one or more tines being clear of the conductor receiving cavity, and a terminated position in which the one or more tines protrude into the conductor receiving cavity to pierce the insulating covering of an insulated conductor received therein, the second insulating housing being receivable within the chamber of the first insulating housing with the header pins being introduced through the entrances and into the header receiving cavities, and in that when the electrical contacts are in the terminated position each contact area protrudes into one of the header receiving cavities such that a respective header pin introduced through one of the entrances is engaged by the contact area such that the header pin is caused to flex, further insertion of the header pin causing it to be received in one of the orifices, the header pin being urged against the contact area to provide an electrical connection therewith.

13. An electrical connector for making an electrical connection between an insulated conductor and a header pin having a free end and an intermediate portion, said connector comprising:

an insulating housing having an insulated conductor receiving cavity;

a contact element fixed within said housing and comprising a conductor contacting portion for making electrical connection with an insulated conductor received in said insulated conductor receiving cavity, and a contact area portion for making electrical connection with a header pin;

means forming an entrance cavity in said housing through which a header pin may be inserted; and means forming an end cavity within said housing for receiving the free end of an inserted header pin;

wherein said contact area portion of said contact element is located relative to said entrance cavity such that an inserted header pin, introduced through said entrance cavity, engages said contact area portion of said contact element and is caused to flex, further insertion of the header pin causing the free end of the header pin to be received in said end cavity, thereby urging the intermediate portion of the header pin against said contact area portion to provide electrical connection therewith.

14. The electrical connector as claimed in claim 13, wherein the axis of said entrance cavity is offset from that of said end cavity such that, upon flexure of the header pin, the free end of the header pin is guided into said end cavity.

15. The electrical connector as claimed in claim 13, wherein said contact element has an inclined surface facing said entrance cavity to effect controlled flexure of the header pin.

16. The electrical connector as claimed in claim 13, wherein said contact element has a resilient cantilevered arm which flexes upon being engaged by an inserted header pin.

17. The electrical connector as claimed in claim 13, comprising means defining a recess in one side of said housing through which a contact element may be inserted to make contact with an inserted insulated conductor, said recess located between said entrance cavity and said end cavity.

18. The electrical connector as claimed in claim 13, wherein the header pin is of the type having a sloped surface at its free end, and said end cavity has wall means engageable by the sloped surface of an inserted header pin to effect a camming action between said wall means and the header pin sloped surface to controllably urge the intermediate portion of the header pin against said contact area portion of said contact element.

19. The electrical connector as claimed in claim 13, wherein said housing has a plurality of said conductor receiving cavities, a corresponding plurality of said entrance cavities, and a corresponding plurality of said end cavities, and said electrical connector further comprises:

a corresponding plurality of said contact elements fixed in said housing;

wherein the contact area portion of each said contact element is located relative to a corresponding one of said entrance cavities such that an inserted header pin, introduced through each said entrance cavity, engages the contact area portion of a corresponding one of said contact elements and is caused to flex, further insertion of the header pin causing the free end of the header pin to be received in a corresponding one of said end cavities, thereby urging the intermediate portion of the header pin against the contact area portion of the corresponding one of said contact elements to provide electrical connection therewith.

* * * * *